US009799300B2

(12) United States Patent
Xiong

(10) Patent No.: US 9,799,300 B2
(45) Date of Patent: Oct. 24, 2017

(54) VOLTAGE COMPENSATING CIRCUIT AND VOLTAGE COMPENSATING METHOD BASED ON THE VOLTAGE COMPENSATING CIRCUIT

(71) Applicant: Shenzhen China Star Optoelectronics Technology Co., Ltd., Shenzhen, Guangdong (CN)

(72) Inventor: Zhi Xiong, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 183 days.

(21) Appl. No.: 14/787,560

(22) PCT Filed: Aug. 10, 2015

(86) PCT No.: PCT/CN2015/086501
§ 371 (c)(1),
(2) Date: Oct. 28, 2015

(87) PCT Pub. No.: WO2017/012155
PCT Pub. Date: Jan. 26, 2017

(65) Prior Publication Data

US 2017/0162165 A1 Jun. 8, 2017

(30) Foreign Application Priority Data

Jul. 17, 2015 (CN) ..... 2015 1 0425554

(51) Int. Cl.
*G09G 3/36* (2006.01)

(52) U.S. Cl.
CPC ..... *G09G 3/3696* (2013.01); *G09G 3/3677* (2013.01); *G09G 2300/043* (2013.01); *G09G 2320/041* (2013.01); *G09G 2320/0646* (2013.01); *G09G 2320/0666* (2013.01); *G09G 2330/00* (2013.01)

(58) Field of Classification Search
CPC ..... G09G 1/005; G09G 2330/00–2330/12
See application file for complete search history.

(56) References Cited

U.S. PATENT DOCUMENTS

2008/0122824 A1* 5/2008 Lee ..... G09G 3/3696 345/211
2015/0170571 A1* 6/2015 Park ..... G09G 3/3258 345/690

* cited by examiner

*Primary Examiner* — Sanghyuk Park
(74) *Attorney, Agent, or Firm* — Andrew C. Cheng

(57) ABSTRACT

A voltage compensating circuit and a method thereof are disclosed. The circuit includes a first TFT circuit, a controlling circuit and a scan driving chip. An output terminal of the power management chip of the controlling circuit connects to a first terminal of the third resistor, a second terminal of the third resistor connects to a first terminal of the first resistor, the second terminal of the third resistor connects to a feedback terminal of the chip, the feedback terminal of the chip connects to a first terminal of the second resistor, a second terminal of the second resistor connects to a ground, a second terminal of the first resistor connects to an input terminal of the scan driving chip. A source of the first TFT connects to a first input terminal of the chip, a second input terminal of the chip connects to the first gate driving signal.

8 Claims, 4 Drawing Sheets

VOLTAGE COMPENSATING CIRCUIT AND VOLTAGE COMPENSATING METHOD BASED ON THE VOLTAGE COMPENSATING CIRCUIT

CROSS REFERENCE

This application claims the benefit of Chinese Patent Application No. 201510425554.0, filed Jul. 17, 2015, titled "Voltage Compensating Circuit And Voltage Compensating Method Based On The Compensating Circuit", the entire contents of which are incorporated by reference herein in its entirety.

FIELD OF THE INVENTION

The disclosure is related to liquid crystal display technology field, and more particular to a voltage compensating circuit and a voltage compensating method based on the voltage compensating circuit.

BACKGROUND OF THE INVENTION

In the active matrix liquid crystal display (AM-LCD), each pixel has a thin film transistor (TFT), which may adjust the brightness of each pixel independently, thereby increasing the display effect of the liquid crystal display. A gate on array (GOA) technology is generally used in AM-LCD. GOA technology is a technology for manufacturing the gate scan driving circuit of TFT on a substrate. By using GOA technology, it may decrease the panel frame and the product cost.

As a result of GOA technology, the TFT temperature in the gate scan driving circuit of TFT varies easily with the ambient temperature. When the TFT temperature varies, the electron mobility of the TFT drifts with the variation of the temperature, such that the gate scan driving signal of the TFT fluctuates, and then the grayscale of the liquid crystal display may be non-uniform, and the display quality is decreased. In order to solve the above problems, the current technique generally use an external temperature sensor, the gate scan driving voltage of the TFT is modulated by monitoring the substrate temperature using the temperature sensor. However, since the substrate temperature detected by the temperature sensor is inconsistent with the actual temperature of the TFT in GOA circuit inside the substrate, the substrate temperature detected by the external temperature sensor can not accurately reflect the actual temperature of the TFT in GOA circuit inside the substrate, such that overcompensation or undercompensation of the gate scan driving voltage of the TFT occurs, thereby decreasing the display effect of the screen of the liquid crystal display.

SUMMARY OF THE INVENTION

An embodiment of the present invention provides a voltage compensating circuit and a voltage compensating method based on the voltage compensating circuit, thereby solving the problem of the variation of the substrate temperature that results in decreasing the display effect of the screen of the liquid crystal display.

A first aspect of an embodiment of the present invention provides a voltage compensating circuit, including a first thin film transistor circuit, a controlling circuit and a scan driving chip, wherein:

the first thin film transistor circuit includes a first thin film transistor having a gate connected to a first gate driving signal;

the controlling circuit includes a power management chip, a first resistor R1, a second resistor R2 and a third resistor R3, an output terminal Output1 of the power management chip is connected to a first terminal of the third resistor R3, a second terminal of the third resistor R3 is connected to a first terminal of the first resistor R1, the second terminal of the third resistor R3 is connected to a feedback terminal of the power management chip, the feedback terminal FB of the power management chip is connected to a first terminal of the second resistor R2, a second terminal of the second resistor R2 is connected to a ground, a second terminal of the first resistor R1 is connected to an input terminal VGH of the scan driving chip, and an output terminal Output2 of the scan driving chip outputs the first gate driving signal;

a source of the first thin film transistor is connected to a first input terminal Input1 of the power management chip of the controlling circuit; a second input terminal Input2 of the power management chip is connected to the first gate driving signal; the power management chip is used to detect a voltage variation duration of a driving voltage Vs of the source of the first thin film transistor when the gate of the first thin film transistor receives a current frame of the first gate driving signal, and adjust a magnitude of a gate driving signal high level VGH of the current frame or a next frame of the gate driving signal connected to a second thin film transistor circuit for displaying in an active matrix liquid crystal display according to the voltage variation duration corresponds to a output terminal voltage Voutput1 of the current frame.

In a first possible implementation of the first aspect of the embodiment of the present invention, the second thin film transistor circuit includes a plurality of thin film transistors arranged in different scanning rows, gate driving signals connected to the plurality of thin film transistors arranged in different scanning rows are different.

Combined with the first aspect of the embodiment of the present invention embodiment, in a second possible implementation of the first aspect of the embodiment of the present invention, a voltage VFB of the feedback terminal of the power management chip is a constant.

Combined with the first aspect of the embodiment of the present invention embodiment, in a third possible implementation of the first aspect of the embodiment of the present invention, the first input terminal Input1 detects a source driving voltage of the first thin film transistor.

A second aspect of an embodiment of the present invention provides a voltage compensating method, used for a voltage compensating circuit, the voltage compensating circuit includes a first thin film transistor circuit, a controlling circuit and a scan driving chip, wherein:

the first thin film transistor circuit includes a first thin film transistor having a gate connected to a first gate driving signal;

the controlling circuit includes a power management chip, a first resistor R1, a second resistor R2 and a third resistor R3, an output terminal Output1 of the power management chip is connected to a first terminal of the third resistor R3, a second terminal of the third resistor R3 is connected to a first terminal of the first resistor R1, the second terminal of the third resistor R3 is connected to a feedback terminal of the power management chip, the feedback terminal FB of the power management chip is connected to a first terminal of the second resistor R2, a second terminal of the second resistor R2 is connected to a ground, a second terminal of the first resistor R1 is connected to an input terminal VGH of the scan driving chip, and an output terminal Output2 of the scan driving chip outputs the first gate driving signal;

a source of the first thin film transistor is connected to a first input terminal Input1 of the power management chip of the controlling circuit, a second input terminal Input2 of the power management chip is connected to the first gate driving signal, the power management chip is used to detect a voltage variation duration of a driving voltage Vs of the source of the first thin film transistor when the gate of the first thin film transistor receives a current frame of the first gate driving signal, and adjust a magnitude of a gate driving signal high level VGH of the current frame or a next frame of the gate driving signal connected to a second thin film transistor circuit for displaying in an active matrix liquid crystal display according to the voltage variation duration corresponds to a output terminal voltage Voutput1 of the current frame;

the method includes:

detecting a voltage variation duration of a source driving voltage Vs of the first thin film transistor connected to the first input terminal Input1 of the power management chip when the second terminal Input2 of the power management chip detects variation of the gate driving voltage received within a current frame time of the first gate driving signal, wherein the first gate driving signal is connected to the gate of the first thin film transistor;

looking up an output terminal voltage Voutput1 of the current frame of the power management chip corresponding to the voltage variation duration of the source driving voltage Vs of the first thin film transistor from a corresponding relationship of a rising edge time and the output terminal voltage of the power management chip; and adjusting a magnitude of a gate driving signal high level VGH of the current frame or a next frame of the gate driving signal of the second thin film transistor circuit according to a magnitude of the output terminal voltage Voutput1 of the current frame of the power management chip.

In a first possible implementation of the second aspect of the embodiment of the present invention, the voltage variation duration includes a rising edge duration or a falling edge duration.

Combined with the second aspect of the embodiment of the present invention embodiment, in a second possible implementation of the second aspect of the embodiment of the present invention, the step of adjusting the magnitude of the gate driving signal high level VGH of the current frame or the next frame of the gate driving signal of the second thin film transistor circuit according to the output terminal voltage Voutput1 of the current frame of the power management chip includes:

adjusting the magnitude of the gate driving signal high level VGH of the current frame or the next frame of the gate driving signal of the second thin film transistor circuit according to the following formula:

$$(VGH-VFB)/R1+(V\text{output}1-VFB)/R3=VFB/R2;$$

wherein, VGH is the gate driving voltage high level of the current frame or the next frame of the gate driving signal of the second thin film transistor circuit, VFB is a feedback voltage of the power management chip, Voutput1 is the output terminal voltage of the current frame of the power management chip, R1 is a resistance value of the first resistor, R2 is a resistance value of the second resistor, R3 is a resistance value of the third resistor.

Combined with the second aspect of the embodiment of the present invention embodiment, in a third possible implementation of the second aspect of the embodiment of the present invention, the step of adjusting the magnitude of the gate driving signal high level VGH of the current frame or the next frame of the gate driving signal of the second thin film transistor circuit according to the magnitude of the output terminal voltage Voutput1 of the current frame of the power management chip includes:

adjusting the magnitude of the gate driving signal high level VGH of the current frame or the next frame of the gate driving signal of the second thin film transistor circuit according to the following formula:

$$(VGH-VFB)/R1+(V\text{output}1-VFB)/R3=VFB/R2;$$

wherein, VGH is the gate driving voltage high level of the current frame or the next frame of the gate driving signal of the second thin film transistor circuit, VFB is a feedback voltage of the power management chip, Voutput1 is the output terminal voltage of the current frame of the power management chip, R1 is a resistance value of the first resistor, R2 is a resistance value of the second resistor, R3 is a resistance value of the third resistor.

This shows that, according to a voltage compensating circuit and a voltage compensating method based on the voltage compensating circuit provided by the present invention, when the second terminal Input2 of the power management chip detects the gate driving voltage high level VGH received within a current frame time of the first gate driving signal, a voltage variation duration of a source driving voltage Vs of the first thin film transistor connected to the first input terminal Input1 of the power management chip is detected, then the first gate driving signal is connected to the gate of the first thin film transistor; an output terminal voltage Voutput1 of the current frame of the power management chip corresponding to the voltage variation duration of the source driving voltage Vs of the first thin film transistor is looked up from a corresponding relationship of a rising edge time and the output terminal voltage of the power management chip; a magnitude of a gate driving signal high level VGH of the current frame or a next frame of the gate driving signal of the second thin film transistor circuit is adjusted according to a magnitude of the output terminal voltage Voutput1 of the current frame of the power management chip. In the embodiment of the present invention, if the temperature of TFT varies, when the second terminal Input2 of the power management chip detects the gate driving voltage high level VGH received within a current frame time of the first gate driving signal, a magnitude of the output terminal voltage Voutput1 of the current frame of the power management chip is adjusted according the detection of a voltage variation duration of a source driving voltage Vs of the first thin film transistor connected to the first input terminal Input1 of the power management chip, thus adjusting a magnitude of a gate driving signal high level VGH of the current frame or a next frame of the gate driving signal of the second thin film transistor circuit, and then adjusting a magnitude of a gate driving signal high level VGH of the second thin film transistor circuit according to the variation of the temperature of TFT. Compared with the gate scan driving voltage of TFT modulated by monitoring the substrate temperature using the temperature detector in the current technique, by implementing the embodiment of the present invention, the gate scan driving voltage high level VGH of the thin film transistor is adjusted in real time according to the variation of the temperature of the thin film transistor, thereby increasing the display effect of the screen of the active matrix liquid crystal display.

BRIEF DESCRIPTION OF THE DRAWINGS

In order to more clearly illustrate the embodiments or the technical solutions in the prior art following is the description for the figures. Obviously, in the following description the drawings are only some embodiments of the present invention. Those with ordinary skills in the related art, without creative efforts, can also obtain other drawings based on these drawings.

DETAILED DESCRIPTION OF PREFERRED EMBODIMENTS

The present invention will now be combined with the implementation of the drawings, where a clear example of the technical solutions of the present invention, a complete description of, obviously, the described embodiments are only part of the embodiments of the present invention, but not all embodiments. Based on the embodiments of the present invention, all other embodiments obtained by those of ordinary skill without the creative work are within the scope of protection of the present invention.

An embodiment of the present invention provides a voltage compensating circuit and a voltage compensating method based on the voltage compensating circuit, thereby solving the problem of the variation of the substrate temperature which results in decreasing the display effect of the screen of the liquid crystal display. The descriptions are illustrated in details as following.

Figure 1:
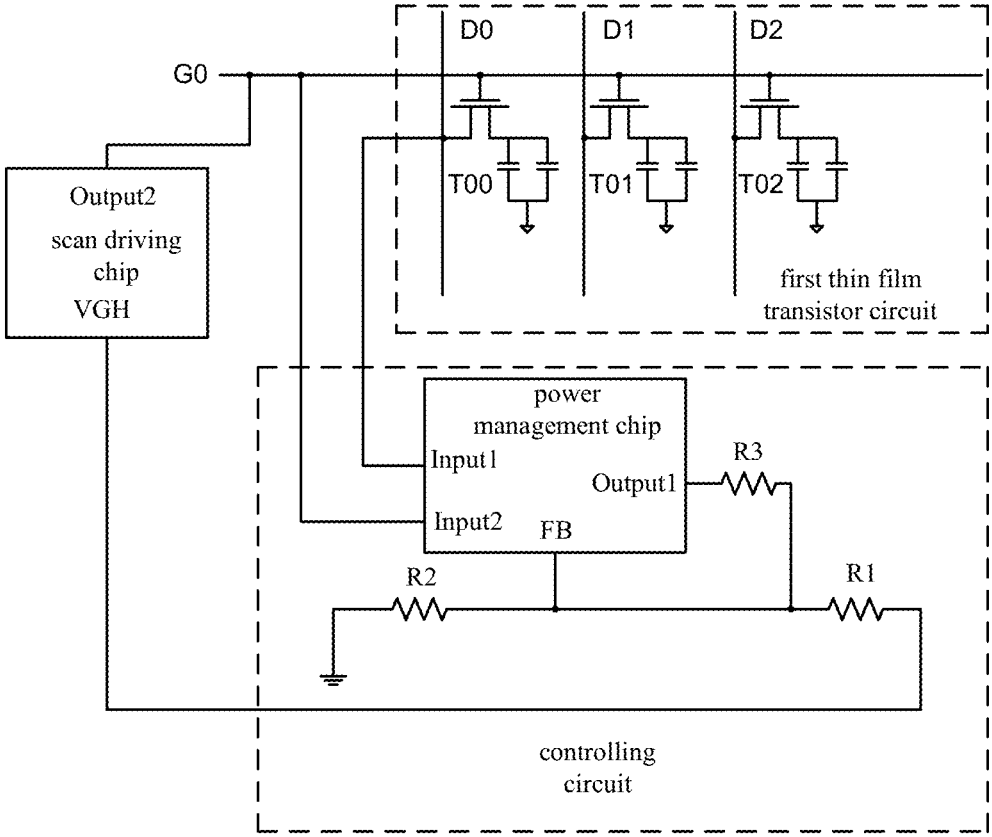
FIG. 1 is a voltage compensating circuit according to an embodiment of present invention.

Please refer to FIG. 1. FIG. 1 is a voltage compensating circuit according to an embodiment of present invention. As shown in FIG. 1, the voltage compensating circuit described in the embodiment includes a first thin film transistor circuit, a controlling circuit and a scan driving chip, wherein:

the first thin film transistor circuit includes a first thin film transistor having a gate connected to a first gate driving signal;

the controlling circuit includes a power management chip, a first resistor R1, a second resistor R2 and a third resistor R3, an output terminal Output1 of the power management chip is connected to a first terminal of the third resistor R3, a second terminal of the third resistor R3 is connected to a first terminal of the first resistor R1, the second terminal of the third resistor R3 is connected to a feedback terminal of the power management chip, the feedback terminal FB of the power management chip is connected to a first terminal of the second resistor R2, a second terminal of the second resistor R2 is connected to a ground, a second terminal of the first resistor R1 is connected to an input terminal VGH of the scan driving chip, and an output terminal Output2 of the scan driving chip outputs the first gate driving signal;

a source of the first thin film transistor is connected to a first input terminal Input1 of the power management chip of the controlling circuit; a second input terminal Input2 of the power management chip is connected to the first gate driving signal; the power management chip is used to detect a voltage variation duration of a driving voltage Vs of the source of the first thin film transistor when the gate of the first thin film transistor receives a current frame of the first gate driving signal, and adjust a magnitude of a gate driving signal high level VGH of the current frame or a next frame of the gate driving signal connected to a second thin film transistor circuit for displaying in an active matrix liquid crystal display according to the voltage variation duration corresponds to a output terminal voltage Voutput1 of the current frame.

In the embodiment of the present invention, the first thin film transistor may be any thin film transistor in the first thin film transistor circuit, and also may be a plurality of thin film transistors in the first thin film transistor circuit. For convenient description for FIG. 1, the first thin film transistor is illustrated by the case of T00. The first thin film transistor is used in the controlling circuit for detecting, and the first gate driving signal G0 connected to the first thin film transistor is outputted by the scan driving chip. When the first gate driving signal G0 outputs high level VGH, the first thin film transistor turns on; when the first gate driving signal G0 outputs low level VGL, the first thin film transistor turns off.

Optionally, a voltage VFB of the feedback terminal of the power management chip is a constant.

Specifically, the voltage VFB of the feedback terminal set by the power management chip according to the process is a constant. When VFB is a constant, the magnitude of the input terminal VGH of the scan driving chip is changed by changing the magnitude of the voltage of the output terminal Output1 of the power management chip, thus modulating the magnitude of high level VGH outputted by the first gate driving signal G0.

Optionally, the first input terminal Input1 detects a source driving voltage of the first thin film transistor.

Specifically, the source of the first thin film transistor is connected to the first input terminal Input1 of the power management chip of the controlling circuit, the first input terminal Input1 of the power management chip may detect the source driving voltage of the first thin film transistor, may detect a rising edge time of the source driving voltage of the first thin film transistor from low level to high level, and also may detect a falling edge time of the source driving voltage of the first thin film transistor form high level to low level.

In the embodiment of the present invention, when a gate driving voltage received from the first gate driving signal G0 inputted by the second input terminal Input2 of the power management chip varies, a voltage variation duration of the driving voltage Vs of the source of the first thin film transistor is detected when the gate of the first thin film transistor receives the current frame of the first gate driving signal G0, wherein the voltage variation duration of the driving voltage Vs of the source of the first thin film transistor is related to the temperature of the first thin film transistor. When the temperature of the first thin film transistor rises, if the gate driving voltage high level VGH received from the first gate driving signal G0 dose not vary, the voltage variation duration of the driving voltage Vs of the source of the first thin film transistor gets shorter. When the temperature of the first thin film transistor falls, if the gate driving voltage high level VGH received from the first gate driving signal G0 dose not vary, the voltage variation duration of the driving voltage Vs of the source of the first thin film transistor gets longer. The magnitude of the gate driving voltage high level VGH of the current frame or the next frame of the gate driving signal connected to second thin film transistor for displaying in the active matrix liquid crystal display may be adjusted according the voltage variation duration of the driving voltage Vs of the source of the first thin film transistor, by implementing the embodiment of the present invention, the gate scan driving voltage high level VGH of the thin film transistor is adjusted in real time according to the variation of the temperature of the thin film transistor, thereby increasing the display effect of the screen of the active matrix liquid crystal display.

Figure 2:
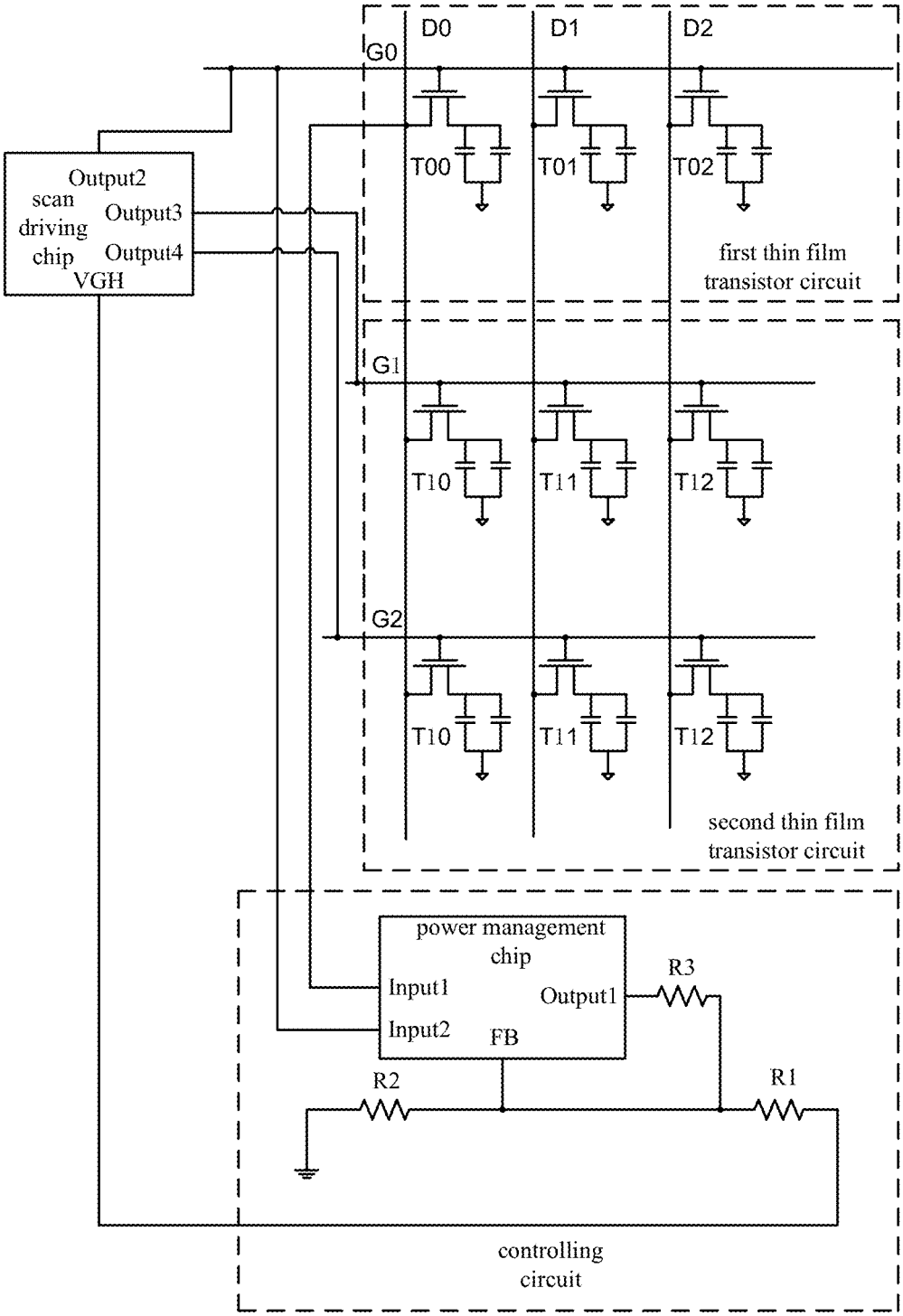
FIG. 2 is another voltage compensating circuit according to an embodiment of present invention.

Please refer to FIG. 2. FIG. 2 is another voltage compensating circuit according to an embodiment of present invention. In the voltage compensating circuit as shown in FIG. 2, the second thin film transistor for displaying in the active matrix liquid crystal display includes a plurality of thin film transistors arranged in different scanning rows, the gate driving signals connected to the plurality of thin film transistors arranged in different scanning rows are different.

In the embodiment of the present invention, the voltage compensating circuit is used to adjust a magnitude of the high level VGH of the gate driving signal connected to the second thin film transistor circuit. The second thin film transistor circuit for displaying may include a plurality of row thin film transistors. Each row thin film transistor may be connected to a gate driving signal, and each row thin film transistor is used to control the brightness and color of one row pixel point on the liquid crystal display screen controlled by the row thin film transistor. The scan driving chip may output a plurality of gate driving signals, such as: G0, G1 and G2, etc., wherein the gate driving signal connected to the second thin film transistor, such as G1, G2, is used to control the display effect of one frame in the liquid crystal display, and the gate driving signal connected to the first thin film transistor, such as G0, is used to control the first thin film transistor to turn-on or turn-off, but not used to the display of the liquid crystal display.

In the embodiment of the present invention, the first thin film transistor circuit and the second thin film transistor circuit are manufactured on a substrate of the liquid crystal display, the gate driving signal of the first thin film transistor circuit not only may be the same as the driving signal of any row thin film transistor in the second thin film transistor circuit, but also may be different from the driving signal of any row thin film transistor in the second thin film transistor circuit, and the gate driving voltage of the first thin film transistor circuit and the gate driving voltage of the second thin film transistor circuit are controlled by the scan driving chip. In one display frame, when the scan driving chip monitors the voltage of VGH of the input terminal is VGH1, in the next one display frame, the high level voltage of the gate driving signal outputted by the output terminal of the scan driving chip is VGH1.

In the embodiment of the present invention, when a gate driving voltage received from the first gate driving signal G0 inputted by the second input terminal Input2 of the power management chip varies, a voltage variation duration of the driving voltage Vs of the source of the first thin film transistor is detected when the gate of the first thin film transistor receives the current frame of the first gate driving signal G0, wherein the voltage variation duration of the driving voltage Vs of the source of the first thin film transistor is related to the temperature of the first thin film transistor. When the temperature of the first thin film transistor increases, if the gate driving voltage high level VGH received from the first gate driving signal G0 dose not vary, the voltage variation duration of the driving voltage Vs of the source of the first thin film transistor gets shorter. When the temperature of the first thin film transistor decreases, if the gate driving voltage high level VGH received from the first gate driving signal G0 dose not vary, the voltage variation duration of the driving voltage Vs of the source of the first thin film transistor gets longer. The magnitude of the gate driving voltage high level VGH of the current frame or the next frame of the gate driving signal connected to second thin film transistor for displaying in the active matrix liquid crystal display may be adjusted according the voltage variation duration of the driving voltage Vs of the source of the first thin film transistor. For example, in one frame duration Tv, if a time of the high level VGH received by the first gate driving signal connected to the first thin film transistor is earlier than a time of the high level VGH received by the gate driving signal connected to the second thin film transistor in the second thin film transistor circuit, a magnitude of the gate driving voltage high level VGH of the current frame of the gate driving signal connected to the second thin film transistor may be adjusted; if a time of the high level VGH received by the first gate driving signal connected to the first thin film transistor is later than a time of the high level VGH received by the gate driving signal connected to the second thin film transistor in the second thin film transistor circuit, a magnitude of the gate driving voltage high level VGH of the next frame of the gate driving signal connected to the first thin film transistor may be adjusted. By implementing the embodiment of the present invention, the gate scan driving voltage high level VGH of the thin film transistor is adjusted in real time according to the variation of the temperature of the thin film transistor, thereby increasing the display effect of the screen of the active matrix liquid crystal display.

Figure 3:
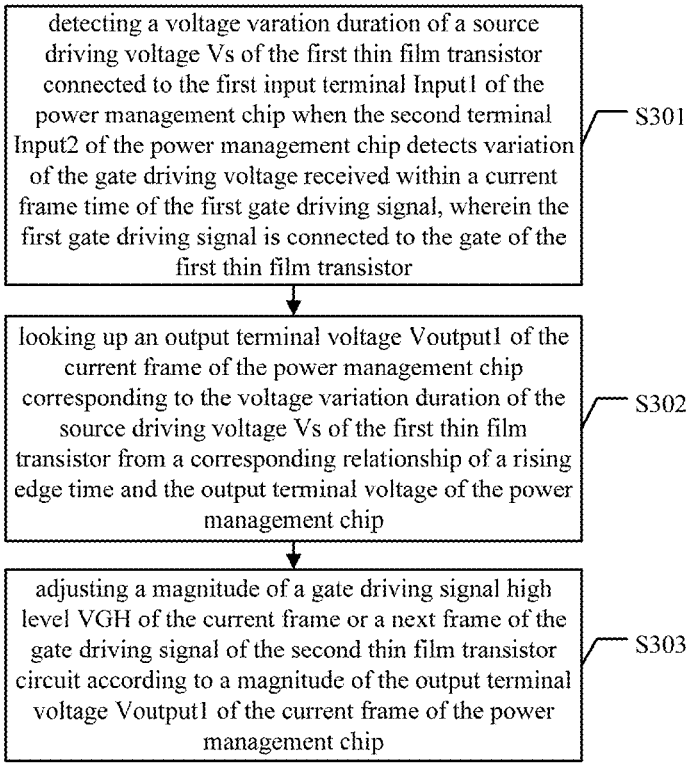
FIG. 3 is a flowchart of a voltage compensating method according to an embodiment of present invention.

Please refer to FIG. 3. FIG. 3 is a flowchart of a voltage compensating method according to an embodiment of present invention. As shown in FIG. 3, the voltage compensating method described in the embodiment includes the following steps:

S301, detecting a voltage variation duration of a source driving voltage Vs of the first thin film transistor connected to the first input terminal Input1 of the power management chip when the second terminal Input2 of the power management chip detects variation of the gate driving voltage received within a current frame time of the first gate driving signal, wherein the first gate driving signal is connected to the gate of the first thin film transistor.

In the embodiment of the present invention, it can also refer to FIG. 1. The variation of the gate driving voltage received within the current frame time of the first gate driving signal G0 may be: the variation of the gate driving voltage received within the current frame time of the first gate driving signal G0 rises to high level VGH from low level VGL, or the variation of the gate driving voltage received within the current frame time of the first gate driving signal G0 falls to low level VGL from high level VGH. When the gate driving voltage received within the current frame time of the first gate driving signal G0 is high level VGH, the first thin film transistor turns on; when the gate driving voltage received within the current frame time of the first gate driving signal G0 is low level VGL, the first thin film transistor turns off. The voltage variation duration of the source driving voltage Vs of the first thin film transistor is related to the temperature of the first thin film transistor. When the temperature of the first thin film transistor rises, if the gate driving voltage high level VGH received from the first gate driving signal G0 dose not vary, the voltage variation duration of the driving voltage Vs of the source of the first thin film transistor gets shorter; when the temperature of the first thin film transistor falls, if the gate driving voltage high level VGH received from the first gate driving signal G0 dose not vary, the voltage variation duration of the driving voltage Vs of the source of the first thin film transistor gets longer.

Optionally, the voltage variation duration of the source driving voltage Vs of the first thin film transistor may include a rising edge duration and also may include a falling edge duration.

Specifically, the detection of the voltage variation duration of the source driving voltage Vs of the first thin film transistor may detect the rising edge duration of the source driving voltage Vs of the first thin film transistor, and also may detect the falling edge duration of the source driving voltage Vs of the first thin film transistor.

S302, looking up an output terminal voltage Voutput1 of the current frame of the power management chip corresponding to the voltage variation duration of the source driving voltage Vs of the first thin film transistor from a corresponding relationship of a rising edge time and the output terminal voltage of the power management chip.

In the embodiment, a corresponding relationship between the rising edge time and the output terminal voltage of the power management chip may be pre-set.

S303, adjusting a magnitude of a gate driving signal high level VGH of the current frame or a next frame of the gate driving signal of the second thin film transistor circuit according to a magnitude of the output terminal voltage Voutput1 of the current frame of the power management chip.

In the embodiment of the present invention, when the output terminal voltage Voutput1 of the current frame of the power management chip increases, the gate driving voltage high level VGH of the current frame or the next frame of the gate driving signal of the second thin film transistor decreases; when the output terminal voltage Voutput1 of the current frame of the power management chip decreases, the gate driving voltage high level VGH of the current frame or the next frame of the gate driving signal of the second thin film transistor increases. That is, the magnitude of the gate driving signal high level VGH of the current frame or the next frame of the gate driving signal of the second thin film transistor circuit is adjusted by detecting the voltage variation duration of the source driving voltage Vs of the first thin film transistor.

Optionally, the step of adjusting the magnitude of the gate driving signal high level VGH of the current frame or the next frame of the gate driving signal of the second thin film transistor circuit according to the magnitude of the output terminal voltage Voutput1 of the current frame of the power management chip may include:

adjusting the magnitude of the gate driving signal high level VGH of the current frame or the next frame of the gate driving signal of the second thin film transistor circuit according to the following formula:

$$(VGH-VFB)/R1+(\text{Voutput}1-VFB)/R3=VFB/R2;$$

wherein, VGH is the gate driving voltage high level of the current frame or the next frame of the gate driving signal of the second thin film transistor circuit, VFB is a feedback voltage of the power management chip, Voutput1 is the output terminal voltage of the current frame of the power management chip, R1 is a resistance value of the first resistor, R2 is a resistance value of the second resistor, R3 is a resistance value of the third resistor.

In the embodiment of the present invention, the feedback terminal voltage VFB of the power management chip may set a constant. For the formula of (VGH−VFB)/R1+(Voutput1−VFB)/R3=VFB/R2, when R1, R2, R3 set as a constant, if Voutput1 increases, then VGH decreases correspondingly; if Voutput1 decreases, then VGH increases correspondingly. That is, the magnitude of VGH is adjusted by adjusting the magnitude of Voutput1.

In the embodiment of the present invention, it can also refer to FIG. 2, when a gate driving voltage received from the first gate driving signal G0 inputted by the second input terminal Input2 of the power management chip varies, a voltage variation duration of the driving voltage Vs of the source of the first thin film transistor is detected when the gate of the first thin film transistor receives the current frame of the first gate driving signal G0, wherein the voltage variation duration of the driving voltage Vs of the source of the first thin film transistor is related to the temperature of the first thin film transistor. When the temperature of the first thin film transistor increases, if the gate driving voltage high level VGH received from the first gate driving signal G0 dose not vary, the voltage variation duration of the driving voltage Vs of the source of the first thin film transistor gets shorter. When the temperature of the first thin film transistor decreases, if the gate driving voltage high level VGH received from the first gate driving signal G0 dose not vary, the voltage variation duration of the driving voltage Vs of the source of the first thin film transistor gets longer. The magnitude of the gate driving voltage high level VGH of the current frame or the next frame of the gate driving signal connected to second thin film transistor for displaying in the active matrix liquid crystal display may be adjusted according the voltage variation duration of the driving voltage Vs of the source of the first thin film transistor. For example, in one frame duration Tv, if a time of the high level VGH received by the first gate driving signal connected to the first thin film transistor is earlier than a time of the high level VGH received by the gate driving signal connected to the second thin film transistor in the second thin film transistor circuit, a magnitude of the gate driving voltage high level VGH of the current frame of the gate driving signal connected to the second thin film transistor may be adjusted; if a time of the high level VGH received by the first gate driving signal connected to the first thin film transistor is later than a time of the high level VGH received by the gate driving signal connected to the second thin film transistor in the second thin film transistor circuit, a magnitude of the gate driving voltage high level VGH of the next frame of the gate driving signal connected to the first thin film transistor may be adjusted.

Figure 4:
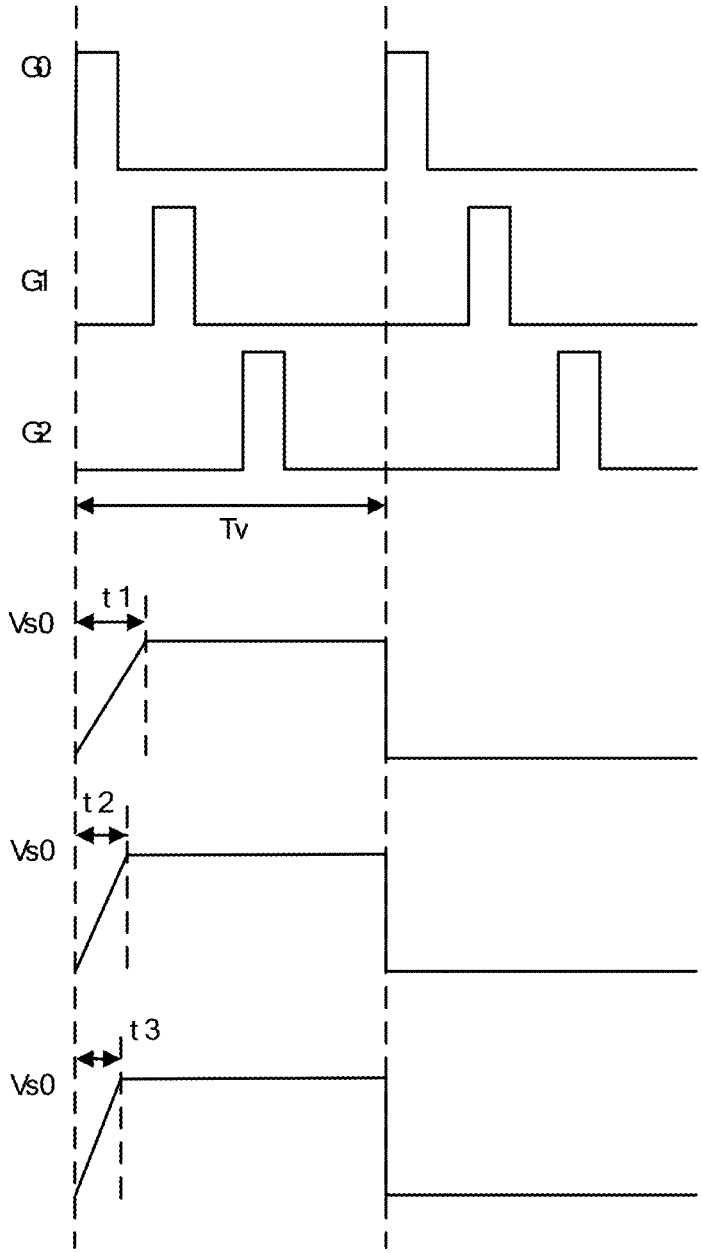
FIG. 4 is a timing diagram of the gate driving signal and the driving voltage of the source of the first thin film transistor according to an embodiment of the present invention.

Specifically, as shown in FIG. 4, FIG. 4 is a timing diagram of the gate driving signal and the driving voltage of the source of the first thin film transistor according to an embodiment of the present invention. In FIG. 4, G0 is the first gate driving signal of the first thin film transistor circuit, G1 and G2 are the gate driving signals of two row thin film transistors of the second thin film transistor circuit. To describe convenience, G1 is assumed as the gate driving signal of the first thin film transistor of the second thin film transistor circuit, G2 is assumed as the gate driving signal of the second thin film transistor of the second thin film transistor circuit, and Tv is a duration of one frame. In conjunction with FIGS. 2 and 4, in one frame duration Tv, when the gate driving voltage received from the first gate driving signal G0 inputted by the second input terminal Input2 of the power management chip varies to high level from low level, a rising edge duration of the driving voltage Vs0 of the source of the first thin film transistor is detected from low level to high level. If the rising edge duration is t1, the output terminal voltage Voutput1-1 corresponding to the rising edge duration t1 is looked up according to a corresponding relationship between the rising edge duration and output terminal voltage of the power management chip, and then the magnitude of VGH is adjusted according to the magnitude of the output terminal voltage Voutput1-1. If the magnitude of the adjusted VGH is VGH1, the scan driving chip adjusts the gate driving signal G1 of the first row thin film transistor in the second thin film transistor circuit as VGH1 and the gate driving signal G2 of the second row thin film transistor in the second thin film transistor circuit as VGH1 within the current frame duration according to the magnitude of VGH1. If the rising edge duration is t2, the output terminal voltage Voutput1-2 corresponding to the rising edge duration t2 is looked up according to a corresponding relationship between the rising edge duration and output terminal voltage of the power management chip, and then the magnitude of VGH is adjusted according to the magnitude of the output terminal voltage Voutput1-2. If the magnitude of the adjusted VGH is VGH2, the scan driving chip adjusts the gate driving signal G1 of the first row thin film transistor in the second thin film transistor circuit as VGH2 and the gate driving signal G2 of the second row thin film transistor in the second thin film transistor circuit as VGH2 within the current frame duration according to the magnitude of VGH2. If the rising edge duration is t3, the output terminal voltage Voutput1-3 corresponding to the rising edge duration t3 is looked up according to a corresponding relationship between the rising edge duration and output terminal voltage of the power management chip, and then the magnitude of VGH is adjusted according to the magnitude of the output terminal voltage Voutput1-3. If the magnitude of the adjusted VGH is VGH3, the scan driving chip adjusts the gate driving signal G1 of the first row thin film transistor in the second thin film transistor circuit as VGH3 and the gate driving signal G2 of the second row thin film transistor in the second thin film transistor circuit as VGH3 within the current frame duration according to the magnitude of VGH3.

Obviously. FIG. 2 only shows two row thin film transistors of the second thin film transistor circuit, but the second thin film transistor circuit further includes other row thin film transistors. The scan driving chip may adjust the magnitude of the high level VGH of the gate driving voltage of the other row thin film transistors in the second thin film transistor circuit according to the magnitude of VGH. The scan driving chip further other output terminals for outputting the gate driving signals of the other row thin film transistors in the second thin film transistor circuit, and all the gate driving signals in the thin transistor circuit are outputted by the scan driving chip. In FIG. 4, in one frame duration Tv, since a time of the high level VGH received by the first gate driving signal connected to the first thin film transistor is earlier than a time of the high level VGH received by the gate driving signal connected to the first row and the second row thin film transistor in the second thin film transistor circuit, a magnitude of the gate driving voltage high level VGH of the current frame of the gate driving signal connected to the first row and the second row thin film transistor may be adjusted. If a time of the high level VGH received by the first gate driving signal connected to the first thin film transistor is later than a time of the high level VGH received by the gate driving signal connected to the first row and the second row thin film transistors in the second thin film transistor circuit, a magnitude of the gate driving voltage high level VGH of the next frame of the gate driving signal connected to the first row and the second row thin film transistors may be adjusted.

By implementing the embodiment of the present invention, the gate scan driving voltage high level VGH of the thin film transistor is adjusted in real time according to the variation of the temperature of the thin film transistor, thereby increasing the display effect of the screen of the active matrix liquid crystal display.

The voltage compensating circuit and the voltage compensating circuit based on the voltage compensating circuit provided by the embodiment of the present invention is described in details as above, this specification uses specific examples to describe the principles and the embodiment of the present invention, and the description of the above embodiments are used to help understand the methods and the core ideas of the present invention; meanwhile, for ordinary skill in the art, according to the idea of the present invention, the specific embodiments and applications are subject to change, and in summary, the contents of the specification should not be construed as limiting the present invention.

What is claimed is:

1. A voltage compensating circuit, comprising a first thin film transistor circuit, a controlling circuit and a scan driving chip, wherein:

the first thin film transistor circuit comprises a first thin film transistor having a gate connected to a first gate driving signal;

the controlling circuit comprises a power management chip, a first resistor, a second resistor and a third resistor, an output terminal of the power management chip is connected to a first terminal of the third resistor, a second terminal of the third resistor is connected to a first terminal of the first resistor, the second terminal of the third resistor is connected to a feedback terminal of the power management chip, the feedback terminal of the power management chip is connected to a first terminal of the second resistor, a second terminal of the second resistor is connected to a ground, a second terminal of the first resistor is connected to an input terminal of the scan driving chip, and an output terminal of the scan driving chip outputs the first gate driving signal;

a source of the first thin film transistor is connected to a first input terminal of the power management chip of the controlling circuit; a second input terminal of the power management chip is connected to the first gate driving signal; the power management chip is used to detect a voltage variation duration of a driving voltage of the source of the first thin film transistor when the gate of the first thin film transistor receives a current frame of the first gate driving signal, and adjust a magnitude of a gate driving signal high level of the current frame or a next frame of the gate driving signal connected to a second thin film transistor circuit for displaying in an active matrix liquid crystal display according to the voltage variation duration corresponds to a output terminal voltage of the current frame.

2. The voltage compensating circuit according to claim 1, wherein the second thin film transistor circuit comprises a plurality of thin film transistors arranged in different scanning rows, gate driving signals connected to the plurality of thin film transistors arranged in different scanning rows are different.

3. The voltage compensating circuit according to claim 1, wherein a voltage of the feedback terminal of the power management chip is a constant.

4. The voltage compensating circuit according to claim 1, wherein the first input terminal detects a source driving voltage of the first thin film transistor.

5. A voltage compensating method, used to a voltage compensating circuit, the voltage compensating circuit comprises a first thin film transistor circuit, a controlling circuit and a scan driving chip, wherein:

the first thin film transistor circuit comprises a first thin film transistor having a gate connected to a first gate driving signal;

the controlling circuit comprises a power management chip, a first resistor, a second resistor and a third resistor, an output terminal of the power management chip is connected to a first terminal of the third resistor, a second terminal of the third resistor is connected to a first terminal of the first resistor, the second terminal of the third resistor is connected to a feedback terminal of the power management chip, the feedback terminal of the power management chip is connected to a first terminal of the second resistor, a second terminal of the second resistor is connected to a ground, a second terminal of the first resistor is connected to an input terminal of the scan driving chip, and an output terminal of the scan driving chip outputs the first gate driving signal;

a source of the first thin film transistor is connected to a first input terminal of the power management chip of the controlling circuit, a second input terminal of the power management chip is connected to the first gate driving signal, the power management chip is used to detect a voltage variation duration of a driving voltage of the source of the first thin film transistor when the gate of the first thin film transistor receives a current frame of the first gate driving signal, and adjust a magnitude of a gate driving signal high level of the current frame or a next frame of the gate driving signal connected to a second thin film transistor circuit for displaying in an active matrix liquid crystal display according to the voltage variation duration corresponds to a output terminal voltage of the current frame;

the method comprising:

detecting a voltage variation duration of a source driving voltage of the first thin film transistor connected to the first input terminal of the power management chip when the second terminal of the power management chip detects variation of the gate driving voltage received within a current frame time of the first gate driving signal, wherein the first gate driving signal is connected to the gate of the first thin film transistor;

looking up an output terminal voltage of the current frame of the power management chip corresponding to the voltage variation duration of the source driving voltage of the first thin film transistor from a corresponding relationship of a rising edge time and the output terminal voltage of the power management chip; and adjusting a magnitude of a gate driving signal high level of the current frame or a next frame of the gate driving signal of the second thin film transistor circuit according to a magnitude of the output terminal voltage of the current frame of the power management chip.

6. The voltage compensating method according to claim 5, wherein the voltage variation duration comprises a rising edge duration or a falling edge duration.

7. The voltage compensating method according to claim 6, wherein the step of adjusting the magnitude of the gate driving signal high level of the current frame or the next frame of the gate driving signal of the second thin film transistor circuit according to the magnitude of the output terminal voltage of the current frame of the power management chip comprises:

adjusting the magnitude of the gate driving signal high level of the current frame or the next frame of the gate driving signal of the second thin film transistor circuit according to the following formula:

$$(VGH-VFB)/R1+(V\text{output}1-VFB)/R3=VFB/R2;$$

wherein, VGH is the gate driving voltage high level of the current frame or the next frame of the gate driving signal of the second thin film transistor circuit, VFB is a feedback voltage of the power management chip, Voutput1 is the output terminal voltage of the current frame of the power management chip, R1 is a resistance value of the first resistor, R2 is a resistance value of the second resistor, R3 is a resistance value of the third resistor.

8. The voltage compensating method according to claim 5, wherein the step of adjusting the magnitude of the gate driving signal high level of the current frame or the next frame of the gate driving signal of the second thin film transistor circuit according to the magnitude of the output terminal voltage of the current frame of the power management chip comprises:

adjusting the magnitude of the gate driving signal high level of the current frame or the next frame of the gate driving signal of the second thin film transistor circuit according to the following formula:

$$(VGH-VFB)/R1+(V\text{output}1-VFB)/R3=VFB/R2;$$

wherein, VGH is the gate driving voltage high level of the current frame or the next frame of the gate driving signal of the second thin film transistor circuit, VFB is a feedback voltage of the power management chip, Voutput1 is the output terminal voltage of the current frame of the power management chip, R1 is a resistance value of the first resistor, R2 is a resistance value of the second resistor, R3 is a resistance value of the third resistor.

* * * * *